US006148736A

United States Patent [19]

Erbs

[11] Patent Number: 6,148,736

[45] Date of Patent: Nov. 21, 2000

[54] VERTICALLY INTEGRATED SERVICE AND STORAGE SYSTEM

[76] Inventor: Harold J. Erbs, 5130 Braesheather, Houston, Tex. 77096-4106

[21] Appl. No.: 09/265,348

[22] Filed: Mar. 9, 1999

[51] Int. Cl.[7] ..... A47B 7/02

[52] U.S. Cl. ..... 108/27; 108/91; 108/101; 108/187

[58] Field of Search ..... 108/27, 91, 92, 108/101, 161, 180, 186, 187, 156, 190; 312/140.4, 196, 209, 280, 351.5, 351.7, 351.8; 248/440.1, 165; 211/188, 194

[56] References Cited

U.S. PATENT DOCUMENTS

| | | | |
|---|---|---|---|
| 1,025,493 | 5/1912 | Vogel | 108/161 |
| 1,038,813 | 9/1912 | Young | 108/91 |
| 1,989,849 | 2/1935 | Davies | 108/101 |
| 3,758,182 | 9/1973 | Barecki et al. | 312/351.8 X |
| 4,930,643 | 6/1990 | Flum | 211/188 |

*Primary Examiner*—Janet M. Wilkens
*Attorney, Agent, or Firm*—Beirne Maynard & Parsons, LLP

[57] ABSTRACT

A molded single unit laboratory vertically integrated service and storage system may be affixed to a laboratory work surface area. The unit includes a plurality of supporting struts with each strut having a foundation securable to the laboratory work surface area or to another unit. The unit includes a shelf member having an outer edge with a lip portion which is in horizontal alignment with the outer surfaces of a plurality of foundations to abate lodging of the unit shelf member storage surface completely against a permanent wall, or the like.

1 Claim, 1 Drawing Sheet

VERTICALLY INTEGRATED SERVICE AND STORAGE SYSTEM

BACKGROUND OF THE INVENTION (1) Field of the Invention

The invention is directed to a vertically integrated service and storage system for affixation to a laboratory work surface area.

(2) Brief Description of the Prior Art

As technology advances, the demands placed on the working environment increase proportionately. The amount of equipment and instrumentation continues to grow, but limited floor space severely impacts efficiency. Work surfaces tend to become cluttered and accessibility of services is almost impossible. This is particularly true with respect to storage units used in laboratories and similar applications. Heretofore, such storage facilities have been provided below a work surface area, and any storage above the work surface area has been provided either by means of open or closed cabinetry or shelving permanently or temporarily fixed to the wall or ceiling thereabove. In some instances, such storage facilities have been provided by literally building same on site through use of wood or similar materials.

In recent years, laboratory tops have been made commercially available by application of molding techniques using epoxy materials. When such techniques are utilized to make such surface areas for laboratories and the like, the molding technique has resulted in a product in which the support legs or structures and the resultant shelving or surface areas are in complete vertical alignment such that the legs and/or support structures and the shelving must be placed flush relative to a wall or other work area, resulting in either lack of full accessibility to the shelving or storage area, or unacceptable or erroneous alignment of the shelving relative to the wall or other surface area.

The present invention addresses the problems identified in prior art products discussed above.

SUMMARY OF THE INVENTION

The invention provides a molded, single unit laboratory vertically integrated service and storage system for affixation to a laboratory work surface area. The storage system includes a plurality of supporting struts with each supporting strut including first and second vertically aligned leg members. The system also includes a foundation means portion having first and second ends and further including outer vertical surfaces which are horizontally offset from the leg members. The foundation means intersects each of the leg members at one end. A smooth face portion is included for inplacement of the system upon the laboratory work surface.

Each of the first and second ends of the foundation means are vertically displaced and extend radially and outwardly of an aligned leg member. At least one shelf member is provided which is supportingly positioned between at least two of the supporting struts.

The shelf member includes a storage surface area and edge sections defining each outer side of the shelf member and including a lip portion extending elevationally away from the work surface. Each of the edge sections are horizontally aligned with an outer vertical surface of the foundation means to thereby assure that the storage system and the shelf member are not inadvertently misaligned with a wall or other abutting surface.

The system is provided in a molded configuration such that the recited elements and members are integrated, one into another.

Any number of required support struts may be utilized, such as first and second end supports and a middle support, or the like.

The storage system may be supplied with one or a plurality of shelf members and each system may be integrated and aligned with another system to "stack" two or more such systems in horizontal alignment or, alternatively, the systems may be connected in conventional fashion, one to another, in horizontal or other alignment.

DESCRIPTION OF THE PREFERRED EMBODIMENT

Figure 1:
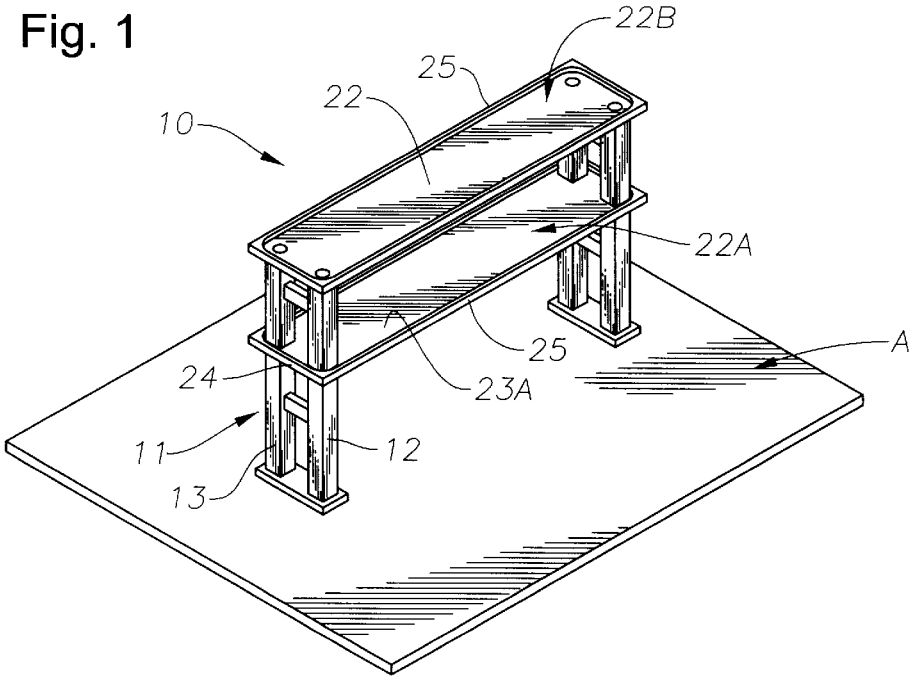
FIG. 1 is a perspective view of the vertically integrated service and storage system of the present invention secured to a laboratory work surface area.
Figure 2:
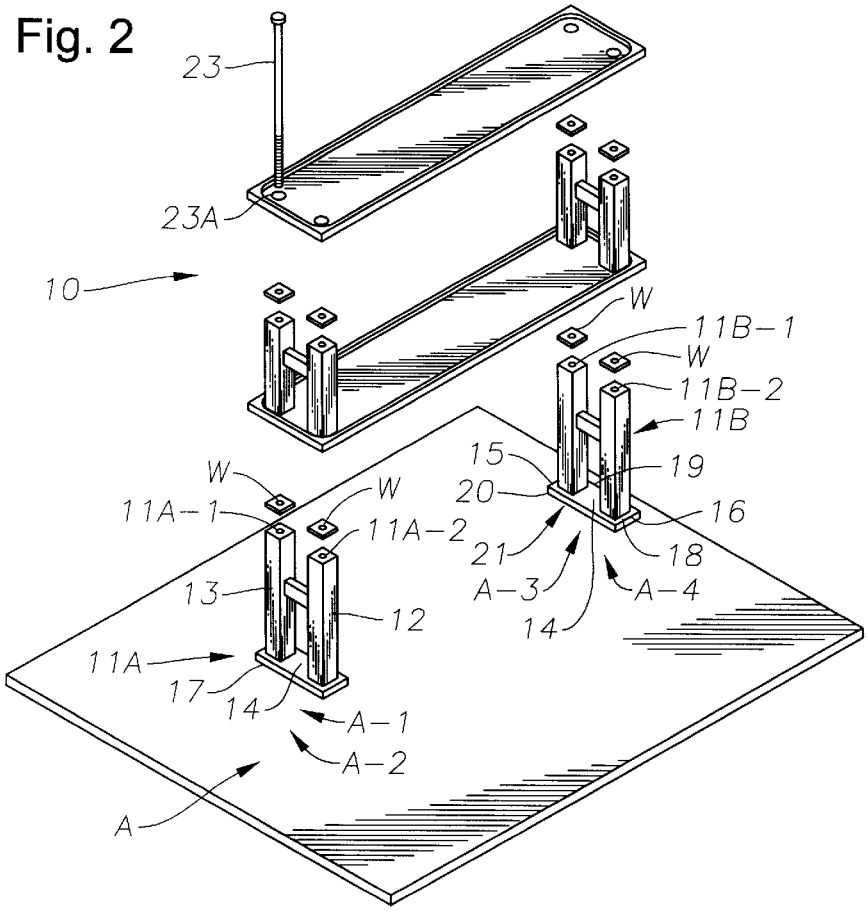
FIG. 2 is a view similar to that of FIG. 1, illustrating the system in component part configuration.

Now with reference to FIG. 1, the system 10 is shown with upper and lower shelf members 22A and 22B respectively. As shown in FIG. 2, the system 10 includes a series of first and second "H" configured struts 11A and 11B. Each of the struts 11A and 11B have leg members 12 and 13 and, as shown in FIG. 2, the leg members 12 and 13 are secured at their lower most end one to another by means of a foundation 14 which has its lower face 21 secured, such as by cementing, screwing or otherwise permanently or temporarily securing same, to a conventional laboratory work surface area A.

As shown in FIG. 2, the foundation means 14 has first and second ends 15 and 16 and the foundation means 14 is shown as being rectangular in configuration with four outer surfaces 17, 18, 19 and 20.

As shown in FIG. 1, each shelf 22A and 22B has a storage surface area 23A and 22. Each storage surface area 23A and 22 has respective upperwardly protruding vertical lip 25 defining an outer edge section 24 for the RESPECTIVE storage surface area 23A, 22. As shown in FIG. 1, the edge section 24 of the lip 25 extends around the outer most perimeter of the storage surface area 23A and 22 and is configured such that it extends radially outwardly of and beyond the leg members. In such fashion, should the system 10 be secured through a work surface A and moved against a wall or other support structure (not shown), the legs 12 and 13 of each of the struts 11 will be offset and away from contacting engagement with the support structure or wall and the storage surface area 23 will not contact such area. The lip 25 thus serves two functions: first, it assures retention upon the storage surface area 23A or 22 of bottles and containers (not shown) and, further, serves as a barrier by being extended outboard of the support struts such that the storage surface area 23A or 22 does not come into contacting engagement with a wall support structure or the like.

FIG. 2 shows the apparatus 10 of the present invention ready for assembly onto a laboratory work surface A. Each of the H members 11A and 11B contain openings 11A-1, 11A-2 and 11B-1 and 11B-2. These vertical openings pass through the respective H member elements 12 and 13 of the respective struts 11 and are aligned with respective holes A-1, A-2, A-3, A-4 through the counter top A. Washers W each are aligned with respective holes in the struts 11, as described, and are placed at the top thereof and the counter top 22A and its corresponding assembly, including the struts

11 and additional washers W are inserted thereon. A bolt 23 is inserted through a bolt opening 23 through the upper most shelf member 22B and through the respective washers W and struts 11 and the respective holes A-1, etc. within the laboratory shelf or top A for securement in conventional fashion. As will be appreciated by study of FIG. 2, the positioning of the struts 11 and the foundation members 14 thereon and the relative horizontal and vertical alignment enables the apparatus 10 to be placed upon the laboratory top or surface A in such a fashion that the struts 11 are displaced or offset relative to a side wall or the like.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A molded single unit laboratory vertically integrated service and storage system for affixation to a laboratory work surface area, comprising:

(a) a plurality of supporting struts, each supporting strut including first and second vertically aligned leg members;

(b) a foundation means having first and second ends and further including outer vertical surfaces horizontally offset of said leg members, said foundation means intersecting each of said leg members at one end thereof and including a smooth face portion for emplacement of the system upon said laboratory work surface area, each of said first and second ends of said foundation means being vertically displaced and extending radially and outwardly of a respective said leg member; and (c) at least one shelf member supportingly positioned between at least one of said supporting struts, said shelf member including a storage surface area and edge sections defining each outer side of said shelf member and including a lip portion extending elevationally away from the storage surface area, each of said edge sections being horizontally aligned with at least one of the outer vertical surfaces of said foundation means.

* * * * *